US009995257B2

(12) United States Patent
Mammarella

(10) Patent No.: US 9,995,257 B2
(45) Date of Patent: Jun. 12, 2018

(54) INTAKE MANIFOLD WITH INTERNAL EXHAUST GAS RECIRCULATION TUBE

(71) Applicant: Mahle International GmbH, Stuttgart (DE)

(72) Inventor: John Ronald Mammarella, Windsor (CA)

(73) Assignee: Mahle International GmbH (DE)

( * ) Notice: Subject to any disclaimer, the term of this patent is extended or adjusted under 35 U.S.C. 154(b) by 0 days. days.

(21) Appl. No.: 15/133,887

(22) Filed: Apr. 20, 2016

(65) Prior Publication Data

US 2017/0306901 A1 Oct. 26, 2017

(51) Int. Cl.
*F02M 35/104* (2006.01)
*F02M 35/10* (2006.01)

(52) U.S. Cl.
CPC .. *F02M 35/1045* (2013.01); *F02M 35/10222* (2013.01); *F02M 35/10321* (2013.01)

(58) Field of Classification Search
CPC ..... F02M 35/1045; F02M 35/10222; F02M 35/10321; F02M 35/1047
See application file for complete search history.

(56) References Cited

U.S. PATENT DOCUMENTS

| | | | | |
|---|---|---|---|---|
| 6,422,221 | B2 | 7/2002 | Pietrowski et al. | |
| 2004/0040527 | A1* | 3/2004 | Murphy | F02D 9/08 123/184.21 |
| 2005/0005890 | A1* | 1/2005 | Asfaw | F02M 35/10144 123/184.61 |
| 2012/0103296 | A1 | 5/2012 | Konakawa et al. | |
| 2013/0072622 | A1 | 3/2013 | Miyamoto et al. | |

* cited by examiner

*Primary Examiner* — Jacob Amick
(74) *Attorney, Agent, or Firm* — Fishman Stewart PLLC

(57) ABSTRACT

An exemplary intake manifold may include an upper manifold configured to receive fresh air, an EGR tube configured to introduce exhaust gas into the upper manifold to be mixed with the fresh air, and a lower manifold configured to distribute the mixture of the fresh air and the exhaust gas cylinders of the internal combustion engine. The upper manifold may include an upper shell and a lower shell that may cooperate to define at least one channel in which at least a portion of the EGR tube may be secured.

17 Claims, 4 Drawing Sheets

INTAKE MANIFOLD WITH INTERNAL EXHAUST GAS RECIRCULATION TUBE

BACKGROUND

Internal combustion engines often incorporate exhaust gas recirculation (EGR) systems to improve exhaust gas quality and fuel efficiency of the engine. In an internal combustion engine, where peak combustion temperature can exceed 2,500 degrees F. (1,372 degrees C.), nitrogen in the air reacts with oxygen to produce nitrous oxides ($NO_x$). To reduce the level of $NO_x$ emissions, an EGR system routes a portion of the exhaust gas to a location upstream of the internal combustion engine where it is mixed with the fresh air supply and then recirculated to the internal combustion engine. The mixture of the exhaust gas with the fresh air supply dilutes the incoming fuel charge, thereby lowering flame temperatures. One location for mixing the exhaust gas with the fresh air supply may be at the intake manifold of the engine.

For internal combustion engines incorporating an EGR system, tubes through which the exhaust gas is routed to the intake manifold run external to the intake manifold, and therefore, more space is required in an engine compartment in which the internal combustion engine and intake manifold are housed. However, weight and space restraints are becoming more critical in vehicles as the designs are becoming more streamlined. One area in which a reduction in space is desired is the engine compartment.

Therefore, there exists a need for an intake manifold incorporating exhaust gas recirculation in a more compact manner to reduce the amount of space that the intake manifold may occupy, for example, within an engine compartment of a vehicle.

DETAILED DESCRIPTION

Exhaust gas recirculation (EGR) may be employed in conjunction with an intake manifold of an internal combustion engine to reduce $NO_x$ emissions. To conserve space, for example, within an engine compartment of a vehicle, the intake manifold may include an internal EGR tube. An exemplary intake manifold may include an upper manifold configured to receive fresh air, an EGR tube configured to introduce exhaust gas into the upper manifold to be mixed with the fresh air, and a lower manifold configured to distribute the mixture of the fresh air and the exhaust gas cylinders of the internal combustion engine. The upper manifold may include an upper shell and a lower shell that may cooperate to define at least one channel in which at least a portion of the EGR tube may be secured.

An exemplary process of manufacturing an intake manifold, such as the exemplary intake manifold described above, may include first forming a lower shell and an upper shell of an upper manifold of the intake manifold, where at least one of the lower shell and the upper shell define at least one channel. The process may then include forming an EGR tube having at least one portion that corresponds to the at least one channel. The process may then include inserting the at least one portion of the EGR tube into the at least one channel. The process may further include attaching the upper shell to the lower shell such that the EGR tube is secured therebetween.

Figure 1:
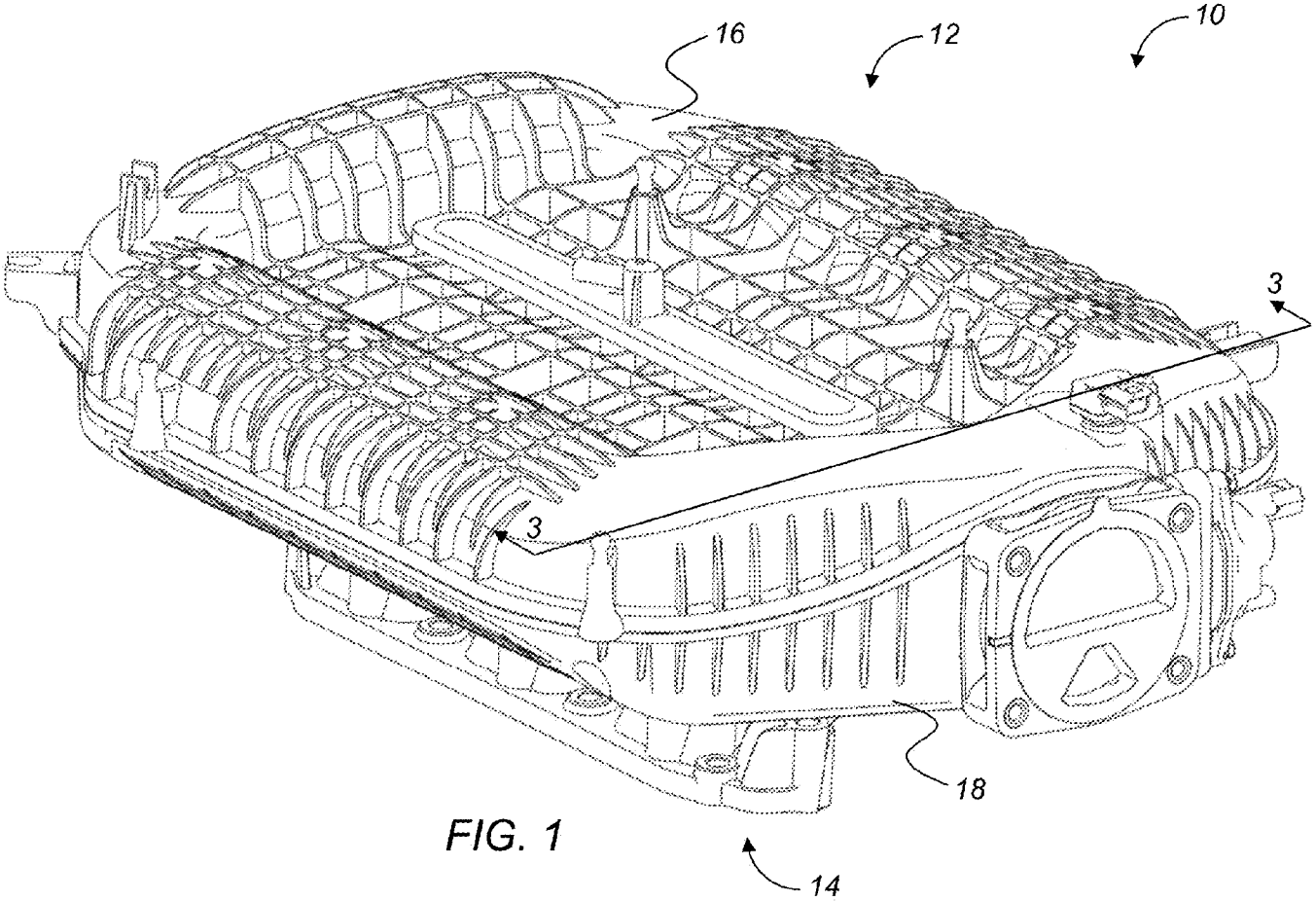
FIG. 1 illustrates a perspective view of an intake manifold according to an exemplary approach.
Figure 2:
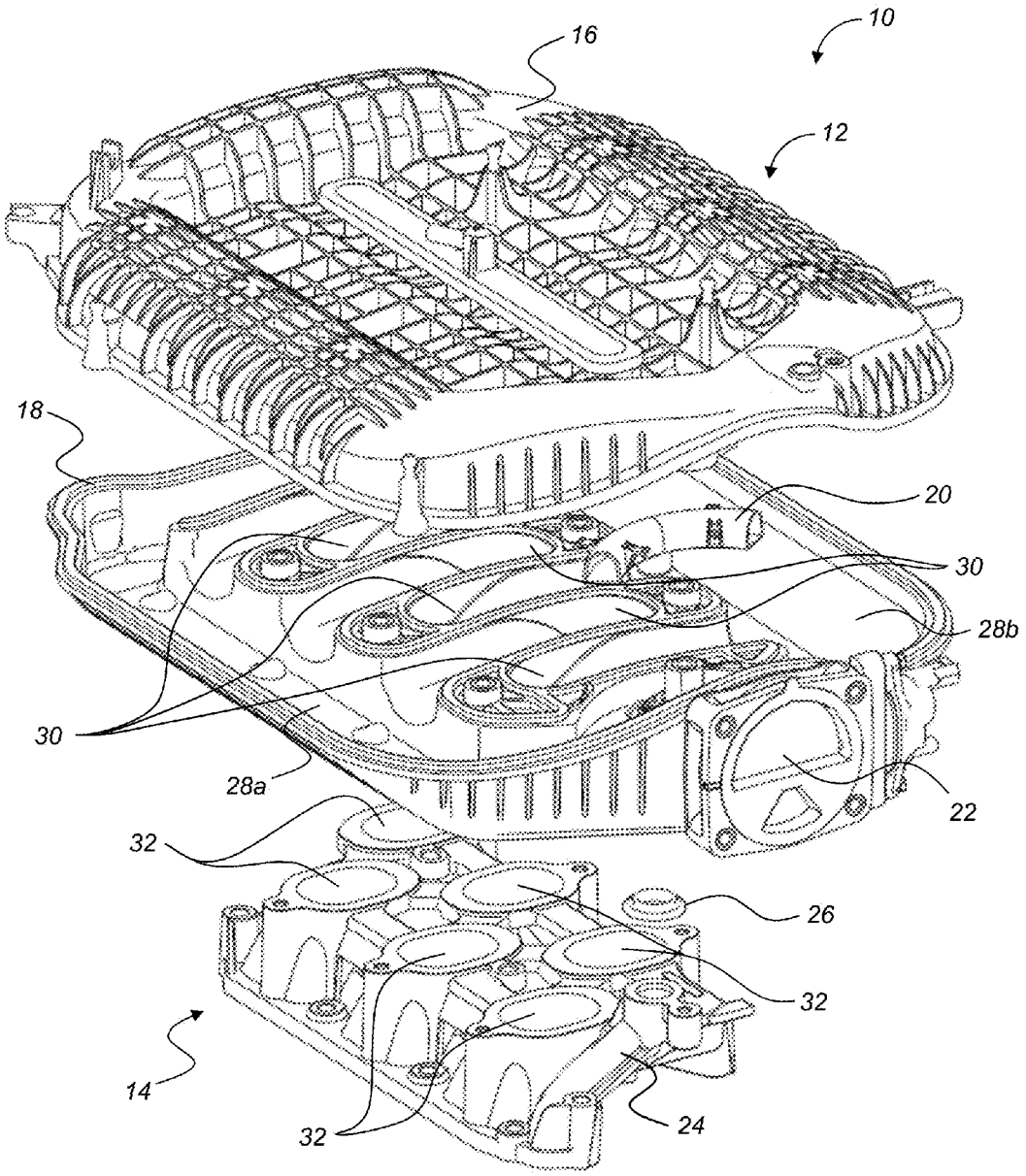
FIG. 2 illustrates an exploded, perspective view of the intake manifold of FIG. 1.
Figure 3:
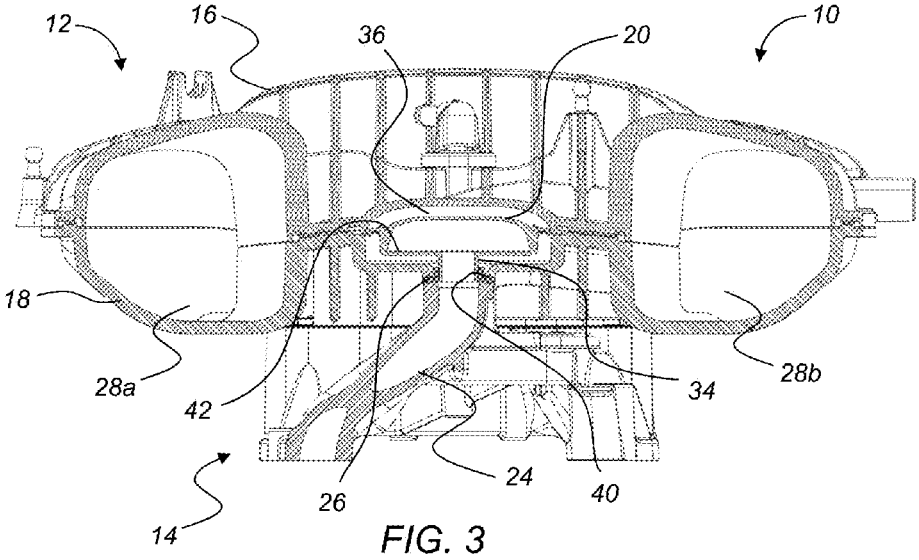
FIG. 3 illustrates a cross-sectional view of the intake manifold of FIG. 1.

Referring now to the figures, FIGS. 1-3 illustrate an exemplary intake manifold 10. The intake manifold 10 generally may be mounted to an internal combustion engine (not shown) to supply air for combination with fuel to form a combustible mixture used to power the internal combustion engine. The intake manifold 10 may include an upper manifold 12 and a lower manifold 14, where the lower manifold 14 may connect the intake manifold 10 to the internal combustion engine. The upper manifold 12 may, in turn, include an upper shell 16 and a lower shell 18. The upper manifold 12 may include an air intake 22 by which fresh air for the combustible mixture may enter the intake manifold 10. While the figures depict the air intake 22 as being part of the lower shell 18 only, it should be appreciated that the air intake 22 may be part of the upper shell 16 only, or may be defined partially by both the upper shell 16 and the lower shell 18.

The intake manifold 10 may also include an exhaust gas recirculation (EGR) tube 20 secured within the upper manifold 12, as described in more detail hereinafter. The EGR tube 20 generally may be configured to introduce exhaust gas from the internal combustion engine into the upper manifold 12 to be mixed with the fresh air. The resulting mixture may then be distributed to cylinders (not shown) of the internal combustion engine. The EGR tube 20 may be located near the air intake 22 such that the exhaust gas may be mixed with the fresh air as it enters the intake manifold 10 to increase the mixing before distribution to the engine cylinders. The lower manifold 14 may include an exhaust gas conduit 24 by which the exhaust gas may flow from the internal combustion engine to the EGR tube 20. The intake manifold 10 may further include a collar 26 connecting the EGR tube 20 and the exhaust gas conduit 24. The collar 26 may also serve as a seal preventing the exhaust gas from coming into contact with any portion of the upper manifold 12 without first being mixed with the fresh air.

Because the exhaust gas may be at very high temperatures (e.g., approximately 200 degrees C.), the EGR tube 20 may be made of a material to withstand such high temperatures. For example, the material may be configured to withstand continuous temperatures as high as 220 degrees C., and intermittent temperatures as high as 240 degrees C. Exemplary materials may include, but are not limited to, plastics, such as a polyamide resin. A plastic material may enable the EGR tube 20 to be lighter and manufactured at a lower cost than other materials, such as steel or metal. Further, the plastic withstands the heat from the exhaust gas, and therefore insulates the intake manifold 10 from the heat, as opposed to conducting the heat from the exhaust gas to the upper manifold 12. In contrast, the upper manifold 12 does not come into direct contact with the exhaust gas, only with combustible mixture at a lower temperature. Therefore, the material of the upper shell 16 and the lower shell 18 does not have to be able to withstand the same high temperatures as the material of the EGR tube 20. For example, the material may be plastic configured to withstand a maximum temperature of only 150 degrees C.

To distribute the mixture of fresh air and exhaust gas to the engine cylinders, the upper shell 16 and the lower shell 18 may define plenums 28*a*, 28*b* into which the fresh air may flow from the air intake 22 and the exhaust gas may flow from the EGR tube 20, as seen in FIGS. 2 and 3. While the figures illustrate the upper manifold 12 as having a dual plenum configuration with two plenums 28*a*, 28*b* branching from the air intake 22 to opposing sides of the upper manifold 12, it should be appreciated that the upper manifold 12 may have any number of plenums, including just one plenum in a single plenum configuration. The plenums 28*a*, 28*b* generally may be sized and configured the same (e.g., spaced equally from the air intake 22) such that the mixture of exhaust gas and fresh air may be evenly distributed to the engine cylinders.

The upper shell 16 and the lower shell 18 may also define channels 30 each in fluid communication with at least one of the plenums 28*a*, 28*b*, and the lower manifold 14 may define a plurality of ports 32 each corresponding to one of the channels 30 and to one of the engine cylinders. In general, the number of channels 30 and ports 32 may correspond to the number of cylinders of the internal combustion engine. While the figures depict a total of six channels 30 and six ports 32 for a 6-cylinder engine, it should be appreciated that the intake manifold 10 may be configured for an internal combustion engine of any number of cylinders, including a 4-cylinder engine and an 8-cylinder engine. After the exhaust gas and the fresh air mix, the mixture may then flow through the plenums 28*a*, 28*b* to each of the channels 30 into the ports 32 to the engine cylinders.

Figure 4:
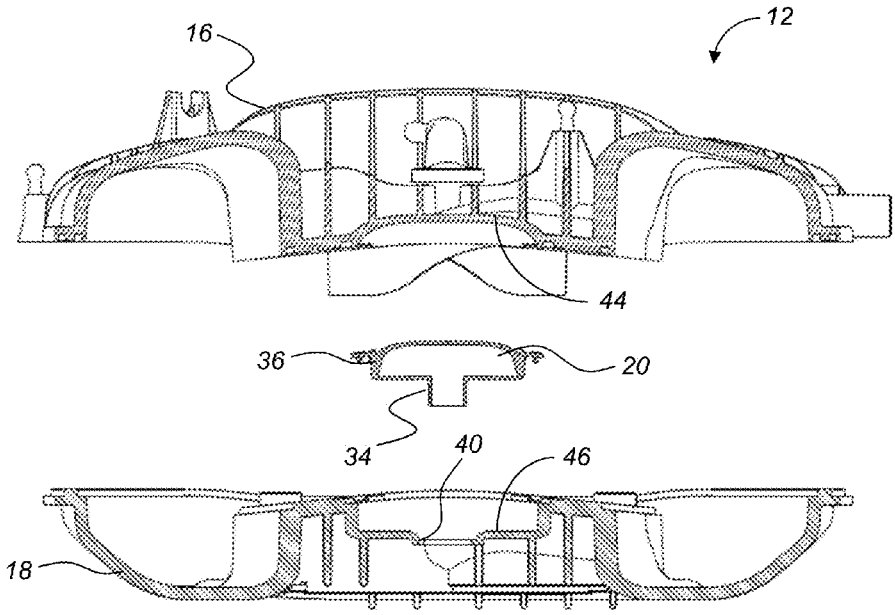
FIG. 4 illustrates an exploded, cross-sectional view of an upper manifold of the intake manifold of FIG. 1.

As seen in FIGS. 3 and 4, in one exemplary approach, the EGR tube 20 may include a first portion 34 and a second portion 36, where the first portion 34 may be configured to receive the exhaust gas from the exhaust gas conduit 24, and the second portion 36 may be configured to distribute the exhaust gas to the plenums 28*a*, 28*b* to be mixed with the fresh air. For a dual plenum configuration, as illustrated in the figures, the second portion 36 of the EGR tube 20 may be open on each end such that the exhaust gas may flow into each of the plenums 28*a*, 28*b*. In addition, the first portion 34 may be connected to a central section of the second portion 36, and the second portion 36 may have the same geometry and configuration on both sides of the connection with the first portion 34 such that the exhaust gas may be equally distributed to the respective plenums 28*a*, 28*b*. The second portion 36 may be curved to accommodate a connection point 38 between the upper shell 16 and the lower shell 18, as well as to direct the air closer to the air intake 22. The first portion 34 may have a circular cross-section. While the figures illustrate the second portion 36 as having a flat base, it should be appreciated that the second portion 36 may also have a circular cross-section. The first portion 34 and the second portion 36 may be arranged perpendicular to each other. It should be appreciated that the EGR tube 20 may have other configurations. For example, the second portion 36 may have just one opening through which the exhaust gas enters the upper manifold 12, and may be oriented to still allow for equal distribution to the plenums 28*a*, 28*b*, for example, with the opening at the air intake 22. With such a configuration, the first portion 34 and the second portion 36 may also be a single tubular component.

To secure the EGR tube 20 within the upper manifold 12, the lower shell 18 may define a first channel 40 in which the first portion 34 of the EGR tube 20 may be inserted, and the upper shell 16 and the lower shell 18 may cooperate to define a second channel 42 in which the second portion 36 of the EGR tube 20 may sit. The upper shell 16 may define an upper portion 44 of the channel 42 and the lower shell 18 may define a lower portion 46 of the second channel 42. The first channel 40 and the second channel 42 generally may have the same shape and configuration as the first portion 34 and the second portion 36, respectively. For example, where the second portion 36 of the EGR tube 20 is curved, the second channel 42 may similarly be curved with the same curvature radius. The cross-sectional areas of the first channel 40 and the second channel 42 may be slightly larger than the respective cross-sectional areas of the first portion 34 and the second portion 36 such that the first portion 34 and the second portion 36 may be easily installed during assembly of the upper manifold 12.

Figure 5:
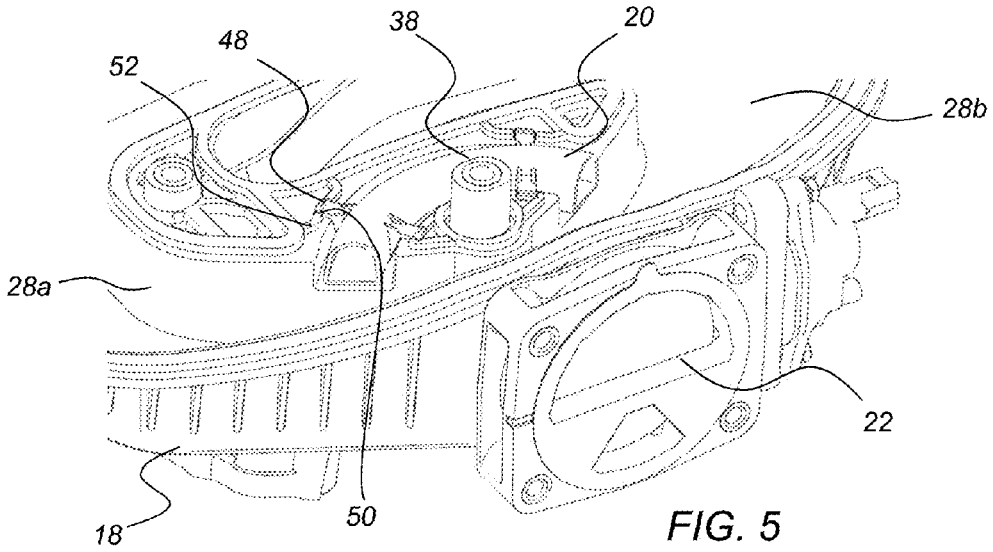
FIG. 5 illustrates a partial, perspective view of a lower shell of the upper manifold, and an exhaust gas recirculation (EGR) tube of the intake manifold of FIG. 1.

To further secure the EGR tube 20 within the upper manifold 12, the second portion 36 of the EGR tube 20 may include tabs 48 extending from the second portion 36, as seen in FIG. 5. The tabs 48 may fit within corresponding grooves 50 in ridges 52 of the lower shell 18. The tabs 48 may be joined together with the grooves 50 and/or the ridges 52 to permanently attach the EGR tube 20 to the lower shell 18. Any process may be used to join the tabs 48 to the grooves 50 and/or the ridges 52, including, but not limited to, welding, friction welding, soldering, or the like. Thus, the EGR tube 20 may be secured within the upper manifold 12 without the use of any external fasteners.

Figure 6:
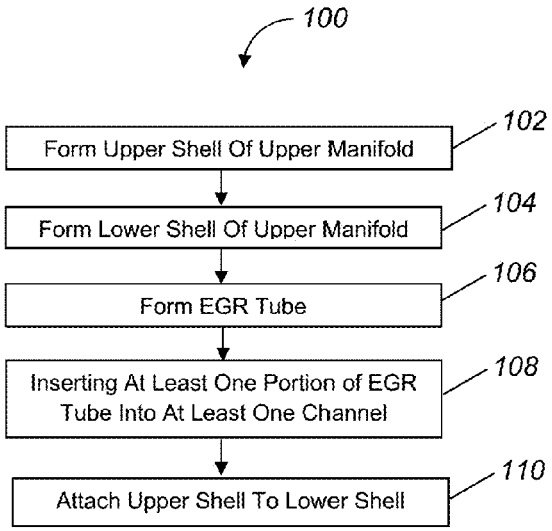
FIG. 6 illustrates an exemplary process for manufacturing an intake manifold with an internal EGR tube.

Referring now to FIG. 6, a process 100 for manufacturing an intake manifold having an internal EGR tube is shown, such as intake manifold 10, is shown. While process 100 is described with respect to intake manifold 10 described above, it should be appreciated that process 100 may be applied to any intake manifold incorporating an internal EGR tube. Process 100 may begin at blocks 102 and 104 in which an upper shell 16 and a lower shell 18, respectively, may be formed. Blocks 102 and 104 may be interchangeable. The upper shell 16 and the lower shell 18 may be formed by any process, including, but not limited to, molding. The lower shell 18 may define a first channel 40 to receive a first portion 34 of an EGR tube 20, and the lower shell 18 and the upper shell 16 may define a lower portion 46 and an upper portion 44, respectively, of a second channel 42 configured to receive a second portion of the EGR tube 20. It should be appreciated that the upper shell 16 and/or the lower shell 18 may define just one of the first channel 40 and the second channel 42 depending upon the configuration of the EGR tube 20.

After block 104, process 100 may proceed to block 106 in which the EGR tube 20 may be formed. The EGR tube 20 may be formed by any process or combination of processes, including, but not limited to, molding and welding. For example, the EGR tube 20 may be formed by a one-step injection molding process. Alternatively, each of the portions 34 and 36 may be formed by a one-step injection molding process, and then joined together by welding. As yet another alternative, each of the portions 34 and 36 may be formed by molding two mating parts that are welded together, and then welding the portions 34 and 36 together.

After block 106, process 100 may proceed to block 108 in which the EGR tube 20 may be inserted into the lower shell 18. This step may include inserting the EGR tube 20 such that the first portion 34 is inserted into the first channel 40, and the second portion 36 sits in the lower portion 46 of the second channel 42. Where the EGR tube 20 includes tabs 48 extending from the second portion 36, this step may further include inserting the tabs 48 into grooves 50 of ridges 52, and further joining the tabs 48 with the grooves 50 and/or the ridges 52, for example, by welding, friction welding, or soldering.

After block 108, process 100 may proceed to block 110 in which the upper shell 16 may be attached to the lower shell 18, thereby enclosing the EGR tube 20 within the upper manifold 12. The upper shell 16 and the lower shell 18 may be attached by any mechanism, including, but not limited to fasteners, and/or processes, including, but not limited to, welding.

After block 110, process 100 may proceed to block 112 in which the upper manifold 12 may be attached to a lower manifold 14. The upper manifold 12 and the lower manifold 14 may similarly be attached by any mechanism, including, but not limited to fasteners, and/or processes, including, but not limited to, welding. A collar 26 may be provided to connect the first portion 34 of the EGR tube 20 with an exhaust gas conduit 24 of the manifold 14. Process 100 may end after block 110.

With regard to the processes, systems, methods, heuristics, etc. described herein, it should be understood that, although the steps of such processes, etc. have been described as occurring according to a certain ordered sequence, such processes could be practiced with the described steps performed in an order other than the order described herein. It further should be understood that certain steps could be performed simultaneously, that other steps could be added, or that certain steps described herein could be omitted. In other words, the descriptions of processes herein are provided for the purpose of illustrating certain embodiments, and should in no way be construed so as to limit the claimed invention.

Accordingly, it is to be understood that the above description is intended to be illustrative and not restrictive. Many embodiments and applications other than the examples provided would be upon reading the above description. The scope of the invention should be determined, not with reference to the above description, but should instead be determined with reference to the appended claims, along with the full scope of equivalents to which such claims are entitled. It is anticipated and intended that future developments will occur in the arts discussed herein, and that the disclosed systems and methods will be incorporated into such future embodiments. In sum, it should be understood that the invention is capable of modification and variation and is limited only by the following claims.

All terms used in the claims are intended to be given their broadest reasonable constructions and their ordinary meanings as understood by those skilled in the art unless an explicit indication to the contrary in made herein. In particular, use of the singular articles such as "a," "the," "said," etc. should be read to recite one or more of the indicated elements unless a claim recites an explicit limitation to the contrary.

The invention claimed is:

1. An intake manifold for an internal combustion engine, the intake manifold comprising:

an upper manifold configured to intake fresh air, the upper manifold having an upper shell and a lower shell;

an exhaust gas recirculation (EGR) tube configured to introduce exhaust gas into the upper manifold to be mixed with the fresh air;

a lower manifold configured to distribute the mixture of fresh air and exhaust gas to cylinders of the internal combustion engine, the lower manifold includes an exhaust gas conduit through which the exhaust gas is flowable from the internal combustion engine to the EGR tube;

wherein the upper shell and the lower shell cooperate to define at least one channel in which at least a portion of the EGR tube is secured.

2. The intake manifold of claim 1, wherein the EGR tube is made of a plastic material.

3. The intake manifold of claim 2, wherein the plastic material is configured to withstand a continuous temperature of at least 220 degrees C. and an intermittent temperature of at least 240 degrees C.

4. The intake manifold of claim 2, wherein the plastic material is a polyamide resin.

5. The intake manifold of claim 1, wherein the EGR tube and at least one of the upper shell and the lower shell are made of different materials, where the material of the EGR tube is configured to withstand higher temperatures than the material of the at least one of the upper shell and the lower shell.

6. The intake manifold of claim 1, wherein the upper manifold comprises a dual plenum configuration having two plenums branching from an air intake of the upper manifold to opposing sides of the upper manifold.

7. The intake manifold of claim 6, wherein at least a portion of the EGR tube is curved such that exhaust gas is distributed to the each of the plenums.

8. The intake manifold of claim 1, wherein the EGR tube includes at least one tab, and the lower manifold includes at least one ridge defining at least one groove in which the at least one tab is inserted.

9. The intake manifold of claim 1, further comprising a collar connecting the exhaust gas conduit and the EGR tube in a sealing manner such that the exhaust gas does not come into direct contact with the upper manifold before mixing with the fresh air.

10. A process comprising:

forming a lower shell and an upper shell of an upper manifold of an intake manifold, at least one of the lower shell and the upper shell defining at least one channel;

forming, by a molding process, an exhaust gas recirculation (EGR) tube having at least one portion corresponding to the at least one channel;

inserting the at least one portion of the EGR tube into the at least one channel;

joining at least one tab of the EGR tube with at least one of a ridge of the lower shell and a groove within the ridge; and attaching the upper shell to the lower shell such that the exhaust gas recirculation tube is secured therebetween.

11. The process of claim 10, wherein the EGR tube is formed from a plastic material.

12. The process of claim 11, wherein the plastic material is configured to withstand a continuous temperature of at least 220 degrees C. and an intermittent temperature of at least 240 degrees C.

13. The process of claim 11, wherein the plastic material is a polyamide resin.

14. The process of claim 11, wherein at least one of the upper shell and the lower shell are formed of a material configured to withstand a lower temperature than the plastic material from which the EGR tube is formed.

15. An intake manifold for an internal combustion engine, the intake manifold comprising:

an upper shell and a lower shell, at least one of the upper shell and the lower shell defining an air intake by which fresh air is introduced into the intake manifold;

an exhaust gas recirculation (EGR) tube configured to introduce exhaust gas into the intake manifold to be mixed with the fresh air; and an exhaust gas conduit through which the exhaust gas is flowable from the internal combustion engine to the EGR tube;

wherein at least one of the upper shell and the lower shell define at least one channel in which at least a portion of the EGR tube is secured, a shape of the at least one channel corresponding to a shape of at least a portion of the EGR tube.

16. The intake manifold of claim 15, wherein the EGR tube is made of a plastic material configured to withstand a continuous temperature of at least 220 degrees C. and an intermittent temperature of at least 240 degrees C.

17. The intake manifold of claim 16, wherein at least one of the upper shell and the lower shell are formed of a material configured to withstand a lower temperature than the plastic material from which the EGR tube is formed.

* * * * *